United States Patent [19]

Sopko

[11] 4,419,873

[45] Dec. 13, 1983

[54] SECURITY PADLOCK WITH OPTIONAL SUSPENSION CHAIN

[75] Inventor: Riley M. Sopko, Palos Verdes Estates, Calif.

[73] Assignee: Phillip L. Alfed, Flintridge, Calif.

[21] Appl. No.: 278,623

[22] Filed: Jun. 29, 1981

[51] Int. Cl.[3] ..... E05B 67/02; E05B 67/22

[52] U.S. Cl. ..... 70/38 A; 70/52

[58] Field of Search ..... 70/52, 51, 38 A, 38 R, 70/38 B, 38 C, 20, 31, 35, 39

[56] References Cited

U.S. PATENT DOCUMENTS

| | | | |
|---|---|---|---|
| 59,615 | 11/1866 | Lowshe | 70/52 |
| 1,579,632 | 4/1926 | Best . | |
| 3,422,643 | 1/1969 | Foote . | |
| 3,710,603 | 1/1973 | Miller | 70/52 |
| 3,754,419 | 8/1973 | Taylor | 70/52 |
| 3,835,675 | 9/1974 | Lippisch | 70/52 |
| 4,112,715 | 9/1978 | Uyeda . | |
| 4,290,279 | 9/1981 | Fith | 70/52 |

OTHER PUBLICATIONS

Uyeda, U.S. Application Ser. No. 177,251, filed Aug. 11, 1980.

*Primary Examiner*—Robert L. Wolfe

*Attorney, Agent, or Firm*—Poms, Smith, Lande & Rose

[57] ABSTRACT

A padlock having a body in which a removable lock cylinder is fastened by a removable cylinder guard plate is provided with retainer means for optionally retaining a lock suspension chain, the suspension chain including links having link apertures and the retainer means including a slot in the guard cylinder plate which receives an end link with a detent of the retainer means located in the link aperture, the assembly and fastening of the cylinder guard to the padlock body trapping and retaining the optionally assembled suspension chain to the padlock.

6 Claims, 6 Drawing Figures

SECURITY PADLOCK WITH OPTIONAL SUSPENSION CHAIN

BACKGROUND OF THE INVENTION

This invention relates in general to padlocks and more particularly to an improvement in a security padlock whereby a suspension chain may be optionally assembled and secured to the padlock body.

Various types of padlocks have been employed heretofore in security situations where it is desired to lock a door, cabinet, drawer or the like. The padlock of U.S. Pat. No. 4,112,751 is exemplary of the type of padlock in which the present invention finds particularly suitable utilization. It has been common heretofore to attach a security chain by providing a slot in the padlock body, locating a chain in the slot and then press fitting a pin or other fastener to the padlock body to hold the chain thereto. I have found that it would be desirable to provide an optionally usable means for retaining a suspension chain to the type of padlock of said U.S. Pat. No. 4,112,751 and, as a primary object of the present invention, contemplate that the use of the suspension chain should not only be optional, but should be easily assembled to the lock in a simple, effective and inexpensive manner during assembly of the lock. The primary object of the present invention is to provide such a lock construction which will facilitate the optional use of a suspension chain during assembly of the padlock without the need for additional parts to be assembled, nor the need for additional assembly tools, jigs or fixtures.

SUMMARY OF THE INVENTION

Generally stated, the present invention includes the provision of retainer means provided in association with a guard plate normally assembled to the padlock body during the lock assembly procedures which is adapted to receive an end link of a suspension chain and automatically assemble and trap the chain to the padlock body by the assembly and fastening of the cylinder guard to the padlock. More specifically, the present invention in padlock with optional suspension chain is particularly suitable for use with a padlock having a removable lock cylinder which is normally retained within the padlock body by a removable cylinder guard and wherein the retainer means for optionally retaining the lock suspension chain to the padlock body is formed in a portion of the guard plate. More particularly, the retainer means may comprise a link receiving slot in a sidewall of the guard plate with a detent extending outwardly and integrally of the guard plate into the slot area to penetrate an aperture of a end link located in the slot. The suspension chain end link may be simply manually assembled over the detent in the slot to the guard plate and, when so manually preassembled, the guard plate and suspension chain may be assembled to the lock body and fastened thereto in an otherwise known method, the method and construction of the present invention allowing for an optional preassembly of the chain to the guard and the trapping and retention of the chain to the padlock body prior to the step of securing the guard plate to the padlock body.

A more complete understanding of the present invention in a padlock with optional suspension chain will be afforded to those skilled in the art, and various additional advantages of the present invention will become apparent, from a consideration of the following detailed description of an exemplary embodiment thereof. Reference will be made to the appended sheet of drawings which will first be described briefly.

DETAILED DESCRIPTION OF AN EXEMPLARY EMBODIMENT

Figure 1:
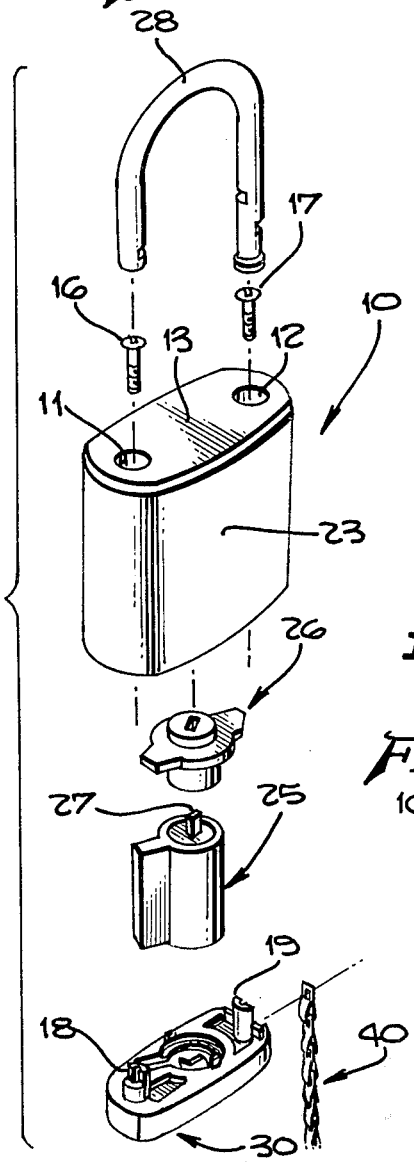
FIG. 1 is an exploded view of an exemplary embodiment of padlock with optional suspension chain according to the present invention showing exemplary shackle means, hollow case means, locking cam means, cylinder means and cylinder guard means.
Figure 2:
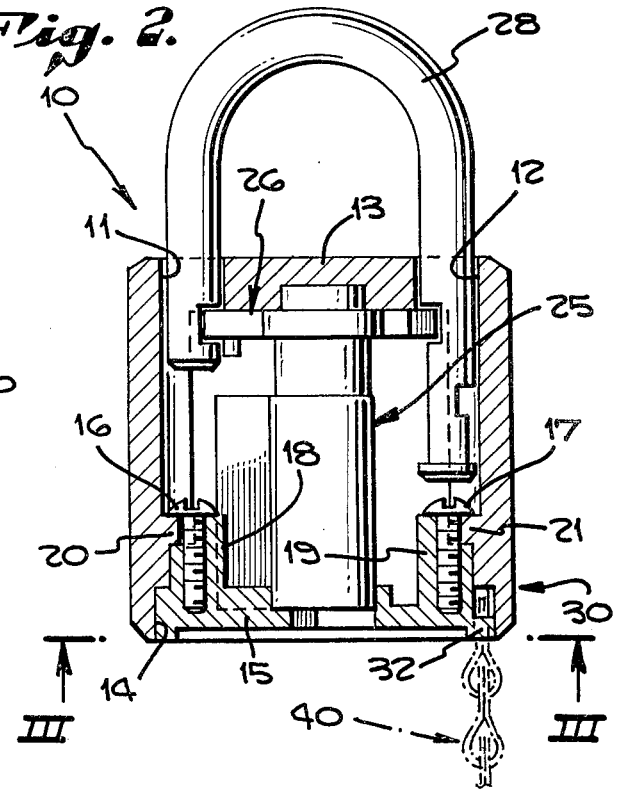
FIG. 2 is a side-sectional view of the padlock of FIG. 1 in the closed, locked position with an optional suspension chain attached thereto.

Referring initially to FIG. 1, an exploded perspective view of an exemplary embodiment of the padlock with optional suspension chain is shown. The padlock, which is essentially like that of U.S. Pat. No. 4,112,715 includes a padlock body, indicated generally at 10, having a pair of shackle bar receiving apertures 11 and 12. The padlock body is hollow, as best seen in FIG. 2, with an upper end 13 being closed and the lower end being provided with an opening 14 which is normally closed by the cylinder guard 15. Fasteners, such as screws 16 and 17 are insertable through the shackle bar receiving apertures 11 and 12 to secure the cylinder guard 15 to the padlock body as seen in FIG. 2. The cylinder guard has upstanding internally threaded bosses 18 and 19 which fit under and adjacent inwardly extending flanges 20 and 21 formed integrally of the interior of the padlock body. Screws 16 and 17 have cap portions which ride over flanges 20 and 21 as the respective screws are turned down into the respective boss portions of the cylinder guard to hold the guard tightly fastened to the padlock as seen in FIG. 2.

Figure 3:
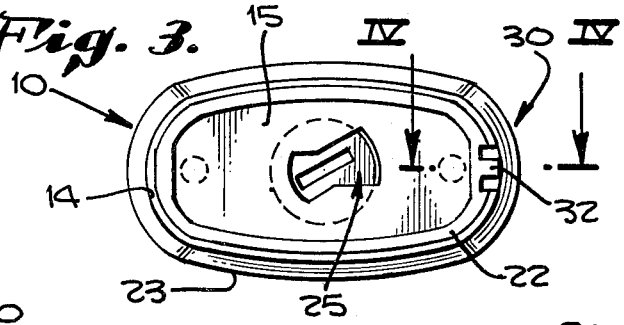
FIG. 3 is an end-sectional view taken along the plane III—III of FIG. 2.

As discussed more fully in the prior U.S. Pat. No. 4,112,715, the removal cylinder guard 15 is provided to receive a lock cylinder, indicated generally at 25 with a mating locking pawl, indicated generally at 26 positioned on top of the cylinder and in engagement with the cylinder pilot 27. Manipulation of the locking pawl, indicated generally at 26 via a key inserted into the lock cylinder, indicated generally at 25 allows for insertion, locking, unlocking and/or removal of the shackle bar 28 in the manner disclosed in said U.S. Pat. No. 4,112,715, the disclosure of which is incorporated herein by this reference. As thus far discussed, the padlock of FIGS. 1 through 3 is essentially identical to that of the aforesaid U.S. Pat. No. 4,112,715. As particularly contemplated within the present invention, retainer means are provided for optionally retaining a lock suspension chain to the padlock body to facilitate chaining or suspending the lock to a desired location of use. A suspension chain securely attached to an area of use may discourage authorized personnel having a key to the lock from moving the lock intentionally, or unintentionally from its intended location of use. In the exemplary embodiment, such retainer means are indicated generally at 30 and include the provision of means for preassembling a suspension chain 40 to the guard plate so that when the guard plate is assembled and fastened to the cylinder body, as seen in FIG. 2, the suspension chain is trapped between the guard plate and cylinder body in a retained condition.

Figure 4:
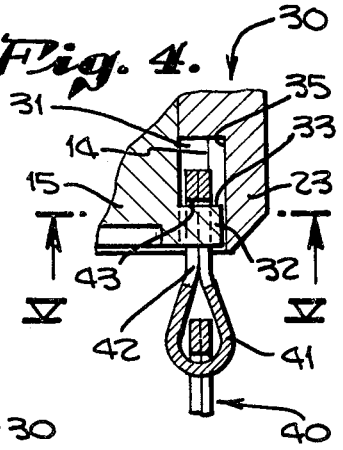
FIG. 4 is a detail section view taken along the plane IV—IV in FIG. 3.
Figure 5:
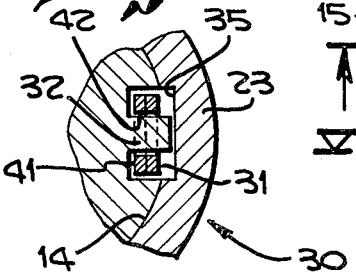
FIG. 5 is a detail section view of the padlock detail of FIG. 4 taken therein along the plane V—V.
Figure 6:
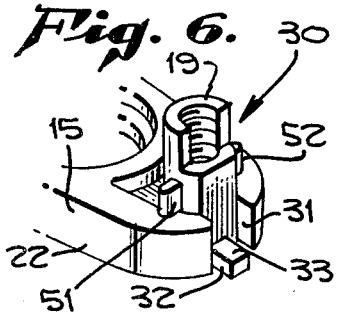
FIG. 6 is a perspective end view of the exemplary cylinder guard means in which an exemplary embodiment of chain retainer means is provided in accordance with the present invention.

The exemplary retainer means includes the provision of a link receiving slot 31 formed in a sidewall 22 of guard plate 15 and an outwardly extending post or detent 32 formed integrally of the guard plate. The exemplary suspension chain 40 comprises a plurality of links, each link including an aperture having an upper end of generally rectangular configuration. By way of example, link 41 in FIG. 4 of suspension chain 40 includes an aperture 42 which provides a horizontal surface 43 which overlies and mates with the flat upper surface 33 of detent 32 which protrudes through link aperture 42 when the upper link 41 of chain 40 is assembled thereto. As best seen in FIG. 5, the padlock body is provided with a relief slot 35 in the sidewall 23 of padlock body 10 in an area opposite and aligned to the guard plate link receiving slot 31. In the illustrated embodiment, detent 32 protrudes into the relief slot 35 ensuring the trapping of the link 41 to the assembly of guard plate 15 and padlock body 10.

As can be seen from the foregoing detailed description of a preferred exemplary embodiment of the present invention in padlock with optional security chain, it should be now apparent to those skilled in the art that a suspension chain, as chain 40, may be located in association with guard plate 15 by fitting an upper link, as link 41, to a retainer means on the guard plate 15, as the retainer means indicated generally at 30 and including slot 31 and detent 32, to thereby preassemble the guard chain optionally to the guard plate preliminary to assembly of the guard plate to the lock during assembly of the locking pawl, indicated generally at 26 and key cylinder, indicated generally at 25 to the lock and their retention therein by the guard plate 15. If a suspension chain is not desired, it need not be assembled to the guard plate which can be assembled to the padlock body 10 without the chain being present. Guard flanges 51 and 52 are provided on either side of boss 19 above the area of slot 31 to deter attempted entry into the lock through the link receiving slot when the link is not employed.

Having thus disclosed an exemplary embodiment of a padlock with optional suspension chain in accordance with the present invention, it should be apparent to those skilled in the art that the present invention accomplishes the objectives and attains the advantages discussed hereinbefore and that various modifications, adaptations and variations of the present invention in padlock can be made within the scope of the present invention which is defined by the following claims.

I claim:

1. In a padlock having a body in which a removable lock cylinder is retained by a removable cylinder guard plate and which has means for fastening the guard plate to the body to retain the cylinder therein, the improvement comprising the provision of:

retainer means for optionally retaining a lock suspension chain to said padlock body wherein said retainer means is operable to retain said chain to said body by the assembly of said guard plate to said padlock body with a portion of said chain trapped between said guard plate and said padlock body.

2. The improvement in padlock of claim 1 wherein said suspension chain comprises a plurality of chain lengths, at least an end length of which has a link aperture, and wherein said retainer means comprises a link receiving slot in a sidewall of said guard plate and an integrally formed detent located in said slot to extend into said link aperture when said link is located in said guard plate slot.

3. The improvement of padlock in claim 2 wherein said padlock body is provided with a relief slot in a sidewall of said body lying about said guard plate and being aligned to said guard plate link receiving slot when said guard plate is assembled to said padlock body.

4. In a padlock having shackle means removably retained in a padlock body which removably receives selectable cylinder means retained therein by a cylinder guard plate which is fastened to said padlock body by fastening means operable through shackle bar receiving apertures in an opposite end of said padlock body from the end to which said guard plate is attached, the improvement in means for retaining a padlock suspension chain to said padlock comprising the provision of:

retainer means formed on said guard plate and automatically assembled to said padlock on the assembly of said guard plate to said padlock, said retainer means being provided so as to trap a portion of said suspension chain between the guard plate and padlock body on assembly of the guard plate with the chain portion located therebetween, whereby a suspension chain may be optionally assembled to said padlock by associating a portion of the chain with said retainer means on said guard plate as said guard plate is assembled to said padlock body.

5. The improvement in padlock of claim 4 wherein said retainer means comprises detent means associated with said guard plate and to which a portion of said chain is aligned before said guard means is assembled to said padlock body.

6. A method of assembly of a padlock suspension chain to a padlock body having a cylinder receiving cavity closed by a cylinder guard plate fastened to said body after a lock cylinder has been located in said cavity comprising the steps of:

locating a portion of a lock suspension chain in the opening to said padlock cavity before assembly of said guard plate to said body; and trapping said portion of said chain to said body by the fastening of said guard plate to said padlock whereby said suspension chain may be optionally assembled to a padlock during the assembly of said guard plate to said padlock body.

* * * * *